US007942596B2

(12) United States Patent
Saunders et al.

(10) Patent No.: US 7,942,596 B2
(45) Date of Patent: May 17, 2011

(54) COSMETIC APPLICATOR

(75) Inventors: Craig M. Saunders, Rocky River, OH (US); Lindsey Tufts, Jr., Eastlake, OH (US); Jeffrey M. Kalman, Cleveland Hts., OH (US); David J. Boll, Avon, OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 380 days.

(21) Appl. No.: 11/970,683

(22) Filed: Jan. 8, 2008

(65) Prior Publication Data

US 2008/0163881 A1 Jul. 10, 2008

(51) Int. Cl.
*B43K 24/02* (2006.01)

(52) U.S. Cl. ..... 401/107; 401/75; 401/78

(58) Field of Classification Search ..... 401/99, 401/107, 75, 77, 78, 108; 132/200
See application file for complete search history.

(56) References Cited

U.S. PATENT DOCUMENTS

| | | | | |
|---|---|---|---|---|
| 2,443,361 | A * | 6/1948 | Satz et al. | 401/59 |
| 2,559,906 | A * | 7/1951 | Tursky | 401/75 |
| 3,007,569 | A * | 11/1961 | Babin | 401/59 |
| 3,617,138 | A * | 11/1971 | Fukui | 401/59 |
| 5,979,468 | A * | 11/1999 | Blake, III | 132/318 |
| 2004/0042838 | A1* | 3/2004 | Lewis et al. | 401/108 |
| 2005/0271451 | A1* | 12/2005 | Brand et al. | 401/108 |
| 2006/0029456 | A1* | 2/2006 | Liu | 401/108 |

* cited by examiner

*Primary Examiner* — David J Walczak
(74) *Attorney, Agent, or Firm* — Fay Sharpe LLP; Karl W. Hauber

(57) ABSTRACT

A cosmetic applicator having an actuator near its top which can be easily used with one hand having an elastomeric top seal is described. The cosmetic applicator is provided with a seal opening sleeve which protects the body of cosmetic from the elastomeric seal during opening operations and closing operations.

12 Claims, 11 Drawing Sheets

COSMETIC APPLICATOR

FIELD OF THE DISCLOSURE

This disclosure relates to cosmetic products and more particularly to a cosmetic applicator and cosmetic product contained in an applicator.

BACKGROUND OF THE DISCLOSURE

Consumers use a wide variety of cosmetic products in many different containers. Some containers are also used as applicators. Many of these products are used at locations remote from the home and therefore must be carried with the consumer while the consumer is working, performing household tasks, shopping, and the like. Many cosmetic products are provided in containers which also function as applicators and which comprise two separable parts. A lipstick is an example. The lipstick product is often contained within a cylindrical base with the top of the cylindrical base protected by a separable cover. In order to use the lipstick product, the consumer must first remove the cover and then advance the lipstick from the base by rotating a ring near the bottom of the base. The lipstick is then used, the body of cosmetic is retracted into the base by operation of the ring, and the cover replaced protecting the top.

Another cosmetic product often carried by consumers is mascara. Again, the mascara is often contained in a two part container/applicator. In order to use the mascara, the consumer must first separate the two halves of the container exposing a brush carrying mascara. The brush is then used to apply the mascara and the brush is then reinserted into the cover where it is protected. Other cosmetic products are contained in similar or dissimilar two part containers. Many of these products have problems. One problem is the nature of the two part container. The two parts can be inadvertently separated in a larger container such as a pocket or a purse resulting in the cosmetic being contaminated and other items in the pocket or purse being discolored by the cosmetic. Another problem is the requirement for using two hands to separate the cosmetic container and/or advance the cosmetic outside of the container for application. This can be particularly troublesome when the consumer is busy. Thus, if one is holding the purse open, driving or otherwise using one hand, using two hands to open and advance a cosmetic product for use can be a problem.

SUMMARY OF THE DISCLOSURE

In accordance with the present disclosure, an improved cosmetic applicator and container is provided in which the container has a side wall; a closed bottom, an open top normally closed by a seal; an actuator engages the container body near the open top and is rotatable with respect to the container body; a body of cosmetic is provided and is movable within the container. The seal provides for closing the container open top in a close state and opening the container open top in an open state. The seal changing between the close state and the open state in response to rotation of the actuator ring. A cosmetic advance is provided for moving the body of cosmetic from a retracted position within the container body to an extended position in which a portion of the body of cosmetic extends through the container body open top in response to rotation of the actuator. The rotation of the actuator in an open direction causes the seal to open prior to advancing a body of cosmetic through the open top for application; and, causes the body of cosmetic to retract within the container prior to the closing of the seal when the actuator is moved in the close direction.

Further in accordance with the disclosure, a seal opening sleeve is provided within the container body which sleeve acts in response to movement of the actuator to open the seal prior to deployment of the body of cosmetic and protect the body of cosmetic from the seal during the retreat of the body of cosmetic back into the container body after completion of use.

Still further in accordance with the disclosure, the actuator is an actuator ring which rotates with respect to the container body and in turn causes rotation of a helix sleeve which interacts with bosses on a cosmetic containing cup. Rotation of the actuator ring and helix sleeve causes the cup to move axially within the container body moving the body of cosmetic toward a dispensing position or back from a dispensing position. Additionally, a seal opening sleeve is provided between the helix sleeve and the cosmetic containing cup, the seal opening sleeve having axial slots accommodating the bosses on the cup and moving axially with the cosmetic containing cup over a portion of its axial travel only.

Still further in accordance with the disclosure, the cosmetic containing cup and seal opening sleeve are releasably engaged to each other when the product retaining cup is in the fully retracted position whereby the seal opening sleeve surrounds the body of cosmetic and opens the seal while moving with the body of cosmetic and then stops allowing the body of cosmetic to extend outwardly from the container body and the seal opening sleeve.

Yet further in accordance with the disclosure, the seal opening sleeve is releasably engaged with the container and/or seal when in the applicator position whereby, upon rotation of the actuator ring in the retract direction, the cosmetic containing cup will move axially independently of the seal opening sleeve until the cosmetic containing cup retracts sufficiently to be surrounded by the seal opening sleeve and hence the two will retract in unison into the closed position.

Yet further in accordance with the disclosure, a cosmetic applicator is provided including a container body having an axis, at least one side wall, a closed bottom and an open top. The applicator further includes an actuator ring rotatable with respect to the container body adjacent the open top. A helix sleeve at least partially within the container body rotates with the actuator ring and includes at least one helix. The applicator further provides an openable seal adjacent the container body open top having an open state and a close state, the seal closing the container body open top when in the close state. A seal opening sleeve at least partially within the container body is provided and is non-rotatable with respect to the container body. The seal opening sleeve having at least one slot generally parallel to the container body axis, a retracted position and an extended position; the slot having a bottom. A cup is adapted to hold a body of cosmetic having an exterior surface and at least one boss extending outwardly from the exterior surface through the seal opening sleeve at least one slot into engagement with the at least one helix on the helix sleeve wherein the cup moves axially when the helix sleeve rotates. A releasable engagement between the cup and the seal opening sleeve is provided for holding the seal opening sleeve to the cup when the seal opening sleeve is in the retracted position whereby the seal opening sleeve moves axially with the cup over a portion of its axial travel and the seal opening sleeve opens the seal allowing the body of cosmetic to project through the seal and the container body open top for use.

And still a further object of the disclosure includes a method of applying a cosmetic comprising providing a body of cosmetic in a cup in a container body having an open top openably closed by a seal and an actuator near the top of the container body. The method further comprises moving the actuator in an open direction causing the seal to open and then causing the body of cosmetic to extend through the open top for application and applying the cosmetic. The moving of the actuator in a close direction causes the body of cosmetic to retreat from the open top and then causes the seal to close, whereby the body of cosmetic is protected by the container body and seal.

It is an object of the present disclosure to provide a cosmetic applicator not requiring separation into two parts for application of the cosmetic contained.

It is another object of the present disclosure to provide a cosmetic applicator which can be opened, used, and closed with one hand.

It is yet another object of the present disclosure to provide a cosmetic container having an actuator near the top, open end of the actuator allowing a user to operate the actuator with the thumb and forefinger while resting the remaining portions of the cosmetic applicator in the hand.

It is yet another object of the present disclosure to provide a cosmetic applicator with a seal which opens and closes without impinging upon the body of the cosmetic contained within the cosmetic applicator.

It is still another object of the present disclosure to provide a cosmetic applicator which protects the cosmetic contained within the applicator from dust, debris and other materials in a purse, pocket or the like when in a closed position.

It is yet another object of the present disclosure to provide a method of applying cosmetics which opens, applies, and closes a cosmetic applicator with one hand.

It is still another object of the present disclosure to provide a cosmetic applicator which is easy and intuitive to operate, easy to store or carry in a purse, reliable in operation and inexpensive to manufacture.

BRIEF DESCRIPTION OF THE DRAWINGS

The foregoing objects, and others, will in part be obvious and in part pointed out more fully hereinafter in conjunction with the written description of several embodiments of the disclosure illustrated in the accompanying drawings in which.

DETAILED DESCRIPTION

Figure 1:
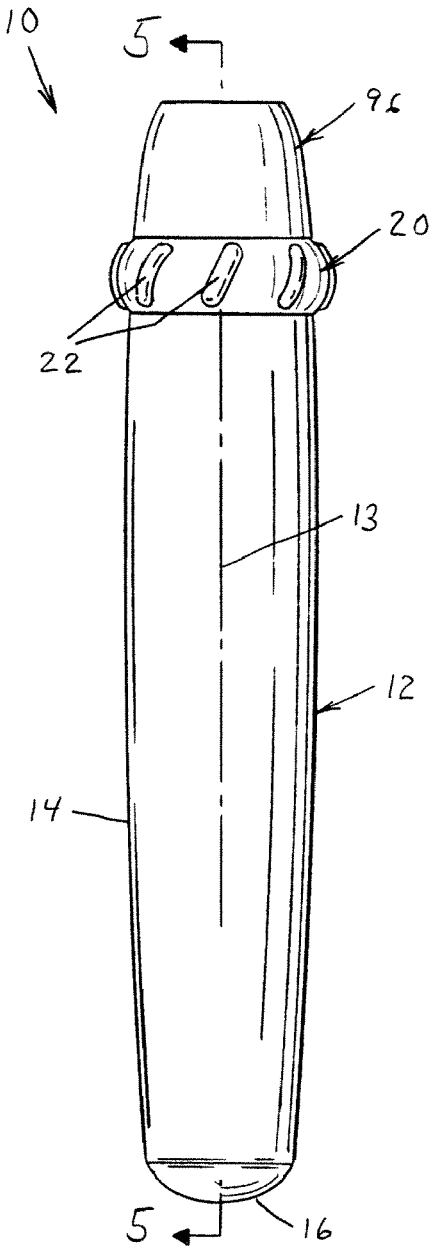
FIG. 1 is a side elevation view of a dispenser in accordance with the present disclosure.
Figure 2:
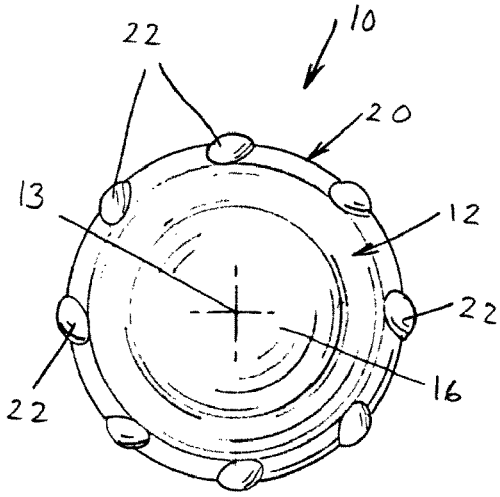
FIG. 2 is a bottom view of the applicator of FIG. 1.
Figure 3:
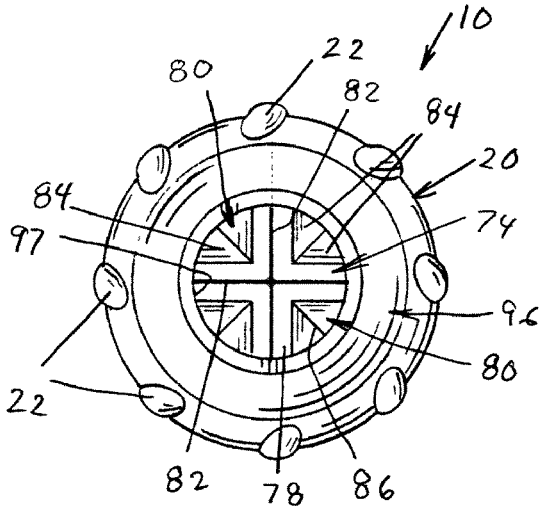
FIG. 3 is a top view of the applicator of FIG. 1.

Referring now in greater detail to the drawings, wherein the showings are for purposes of illustrating several embodiments of the disclosure and not for the purpose of limiting the disclosure, FIG. 1 shows a cosmetic applicator 10 in accordance with the disclosure. A tubular container body 12 encloses most of the working parts of the cosmetic applicator. The container body 12 is generally tubular, and in the embodiment shown, has a downwardly and inwardly tapering side wall 14 terminating in a gently curved closed bottom 16. The container body 12 shown in one exemplary embodiment is generally cylindrical and symmetrical about a longitudinal axis 13. However, the container body can have other shapes such as a tube with a square cross section or elliptical cross section or even a triangular cross section. Moreover, it is not necessary that the container body 12 be tapered.

An actuator ring 20 is provided near the top of the container body 12. The actuator ring has slanted ribs 22 spaced around its periphery making it easy to identify by feel and rotate with a thumb or forefinger. The actuator ring 20 moves in either the clockwise or the counter clockwise direction, relative to the longitudinal axis 13, to operate the cosmetic applicator as herein below described. The actuator ring 20 does not need to be a ring. An actuator button capable of moving clockwise or counter clockwise can perform the same functions as the actuator ring 20. Moreover, an actuator button capable of traveling axially along the outside of the container body 12 can also be used in accordance with the present disclosure, however, with a slightly different translation mechanism as will be hereinafter described.

Figure 4:
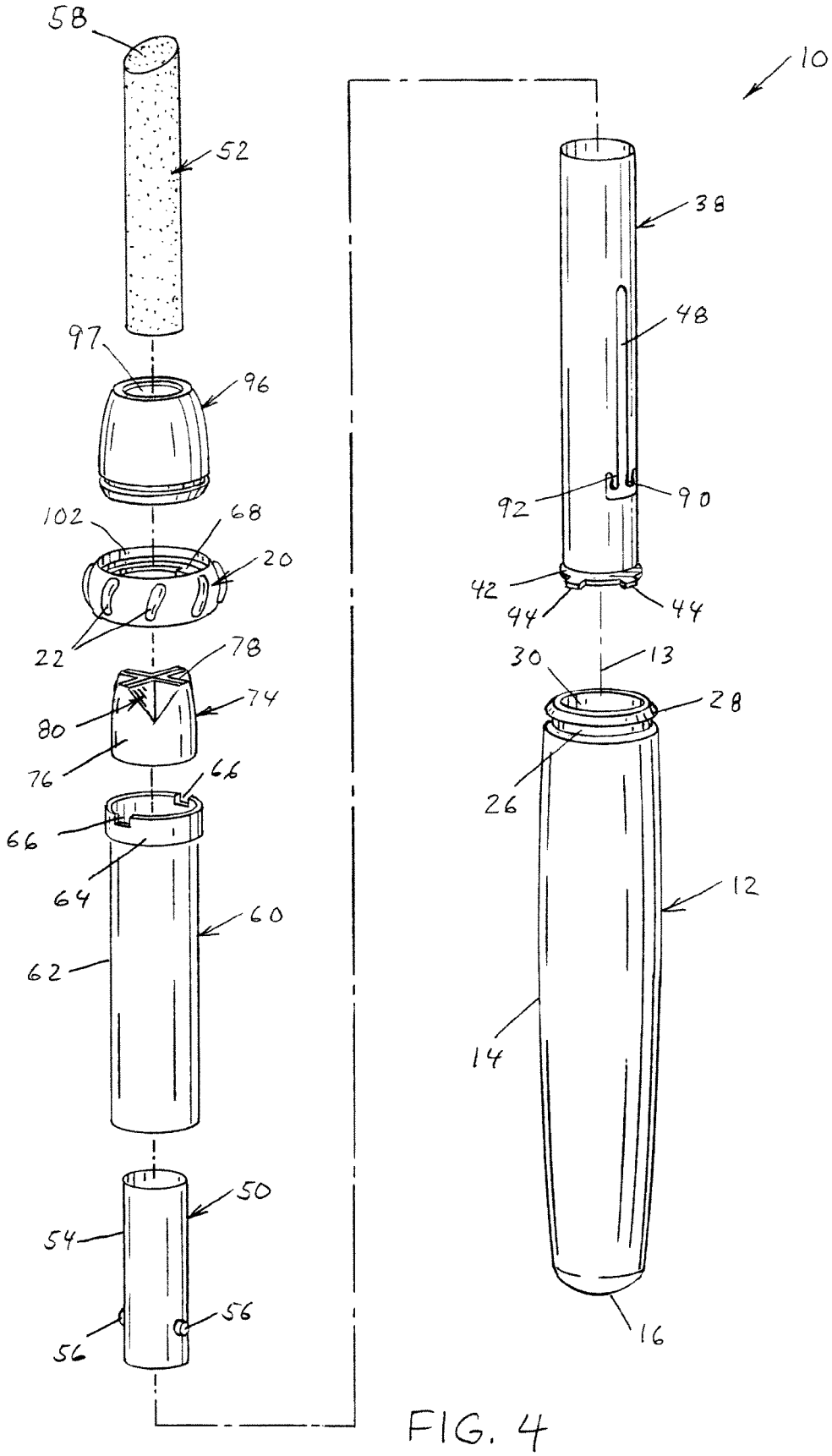
FIG. 4 is an exploded perspective view of the applicator of FIG. 1.
Figure 10:
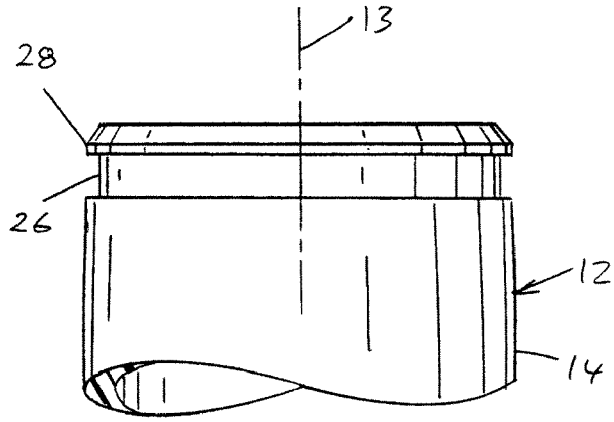
FIG. 10 is an enlarged view of the top end of the container body.
Figure 14:
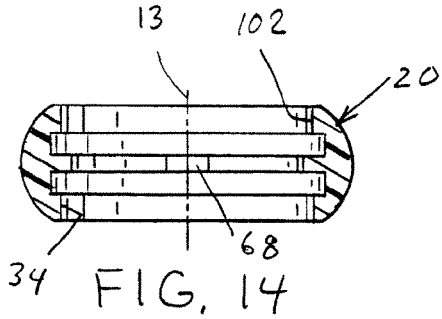
FIG. 14 is a cross sectional view of the actuator ring.

Referring now to FIG. 4, the principal components of the cosmetic applicator 10 are shown in an exploded view. The container body 12 has a circumferential recess 26 near its top and a circumferential outwardly extending flange 28 above the recess 26 (FIG. 10). The open top 30 is disposed directly above the circumferential flange 28. The actuator ring 20 is normally retained on the container body 12 by means of a inwardly extending circumferential flange 34 (FIG. 14) which is rotatably retained in the circumferential recess 26 on the container body 12. Thus, the actuator ring 20 can rotate with respect to the container body 12 but cannot move axially with respect to the container body 12.

Figure 9:
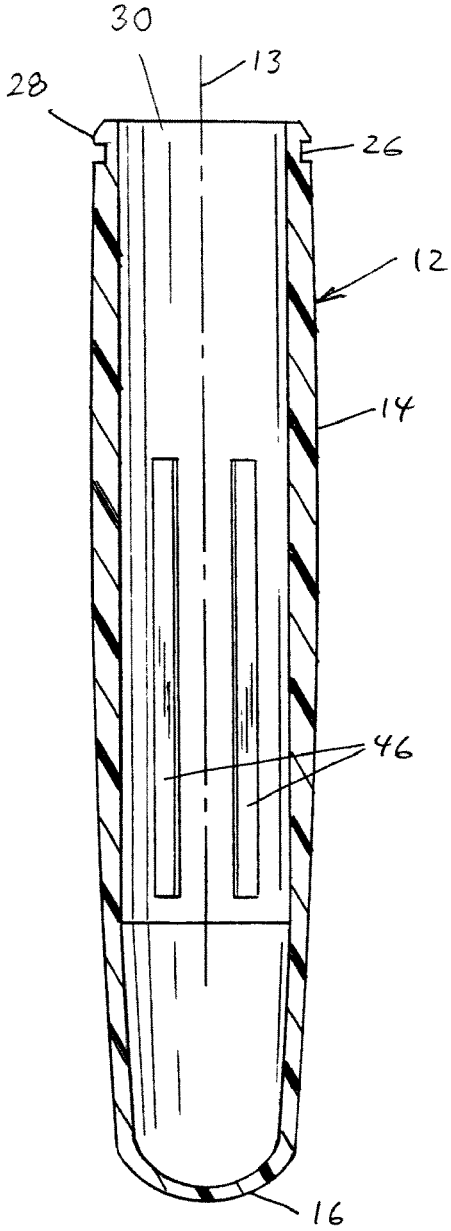
FIG. 9 is an isolated cross sectional view of the container body.
Figure 17:
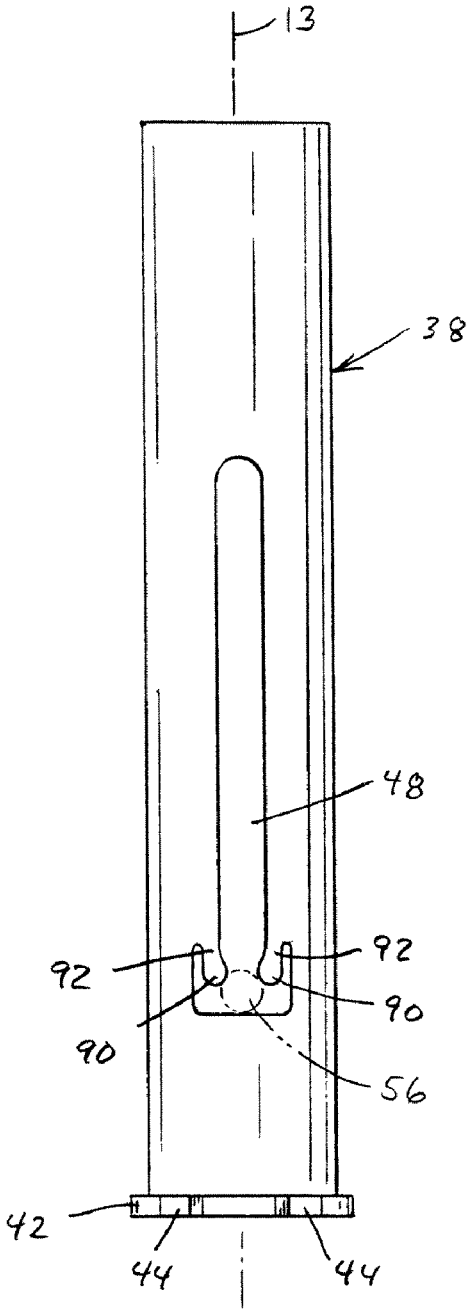
FIG. 17 is an isolated front view of the seal opener sleeve.
Figure 18:
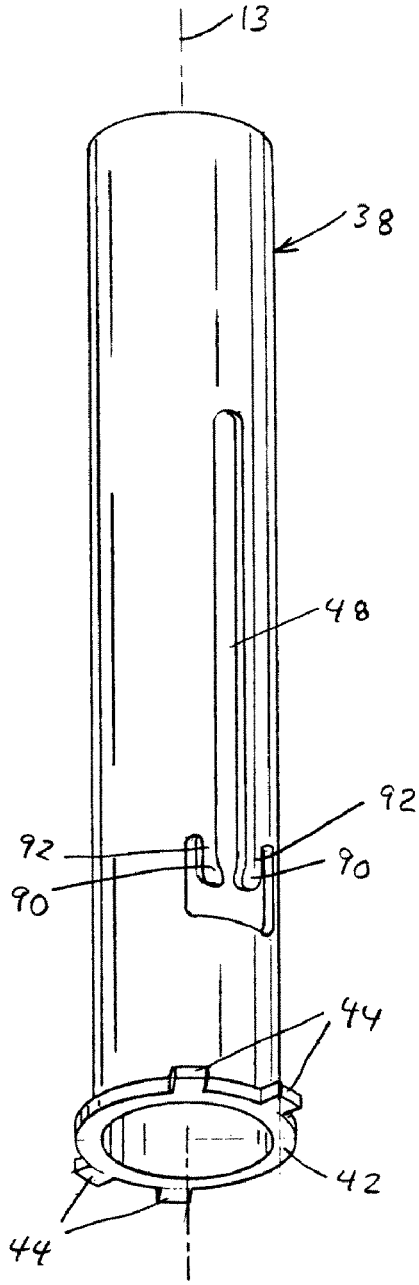
FIG. 18 is a perspective view of the seal opener sleeve.

A seal opening sleeve 38 is generally tubular with a circular cross section and an outwardly extending flange 42 at its bottom. The flange 42 is provided with several outwardly extending teeth 44 (FIGS. 17 and 18). The teeth 44 engage axially extending grooves 46 on the inner surface of the container body side wall 14 (see FIG. 9). The teeth 44 ride in the grooves 46 restraining the seal opening sleeve 38 from rotation with respect to the container body 12 but allowing axial motion over its intended range of motion within the container body 12. The seal opening sleeve 38 is provided with axially extending slots 48. In the embodiment illustrated, two slots 48, diametrically opposed, are provided. One slot, three slots or more slots could also be used.

Figure 15:
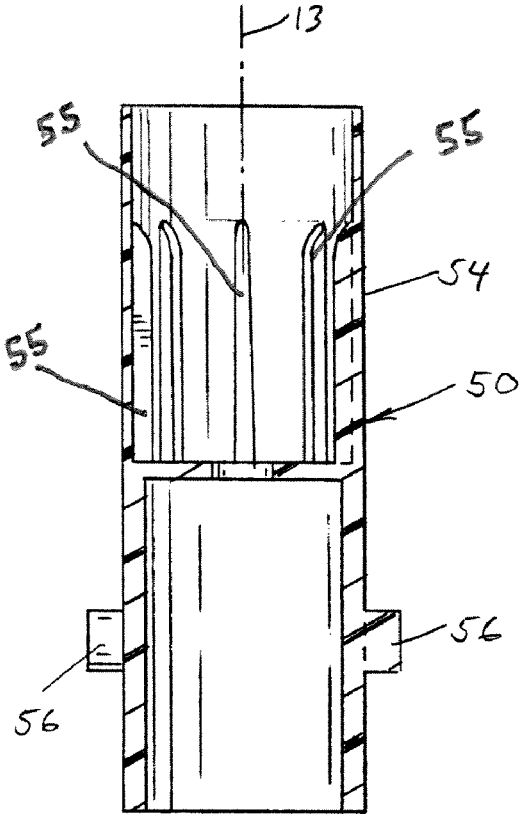
FIG. 15 is an isolated cross sectional view of the cosmetic containing cup.
Figure 16:
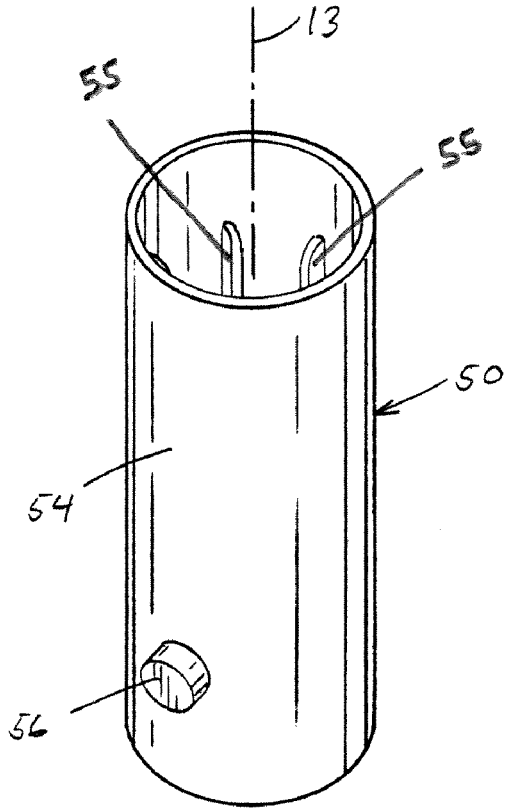
FIG. 16 is a perspective view of the cosmetic containing cup.

A cup 50 (FIGS. 15 and 16) containing a body of cosmetic 52 has a generally cylindrical shape with a single cylindrical side wall 54. The interior of cup 50 includes a series of ribs 55 for frictionally engaging the body of cosmetic 50. The ribs 55 can partially embed into an outer circumference of cosmetic 50 to assist with retention of cosmetic 52 within cup 50. Bosses 56 are provided near the lower end of the cup side wall 54. In the illustrated embodiment, two circular bosses 56 are provided. The number of bosses 56 can be different and should generally correspond with the number of slots 48 in the seal opening sleeve 38. When assembled, the bosses 56 pass through the slots 48. This allows the cup 50 and body of cosmetic 52 to move axially with respect to the seal opening sleeve 38 and the container body 12 but not rotate with respect to these two elements.

A helix sleeve 60 (FIGS. 19-21) is tubular with a generally cylindrical side wall 62 and a radially enlarged top ring 64. The top ring 64 is provided with notches 66 which receive teeth 68 extending inwardly from the actuator ring 20. The inside surface of the helix sleeve side wall 62 is provided with at least one helix 70. The helix can be a groove, as seen in one exemplary embodiment, or a cut extending through the entire depth of the side wall 62 providing one or more helical slots. In the illustrated embodiment, two helical grooves form the helix 70 and accept the two bosses 56 on the cosmetic containing cup 50. Because the teeth 68 on the ring 20 are engaged with the notches 66 on the helical sleeve 60, when one rotates the actuator ring 20, the helix sleeve 60 will rotate with the actuator ring 20. Because the boss 56 on the cosmetic containing cup 50 are retained in the axial slots 48 in the seal opening sleeve, the cup 50 cannot rotate with the helix sleeve 60. Rather, as the helix sleeve 60 rotates, the cup 50 is urged upwardly or downwardly by action of the bosses 56 sliding in the helixes 70.

A seal 74 is fixed to the top end of the helix sleeve 60. The seal 74 can be fabricated from a flexible elastomer such as a thermoplastic elastomer. The seal 74 is fixed to the top of the helix sleeve 60 by means of over molding in this particular embodiment. However, the seal 74 can be fixed to the helix sleeve 60 by means of adhesive or by means of a tight fit or any other means suitable for fixing a last inert body to a rigid plastic body known in the art. Additionally, the seal 74 may be fixed to the top end of the container body 12 rather than to the top of the helix sleeve 60 or seal 74 can be fixed to a top cap 96.

Figure 19:
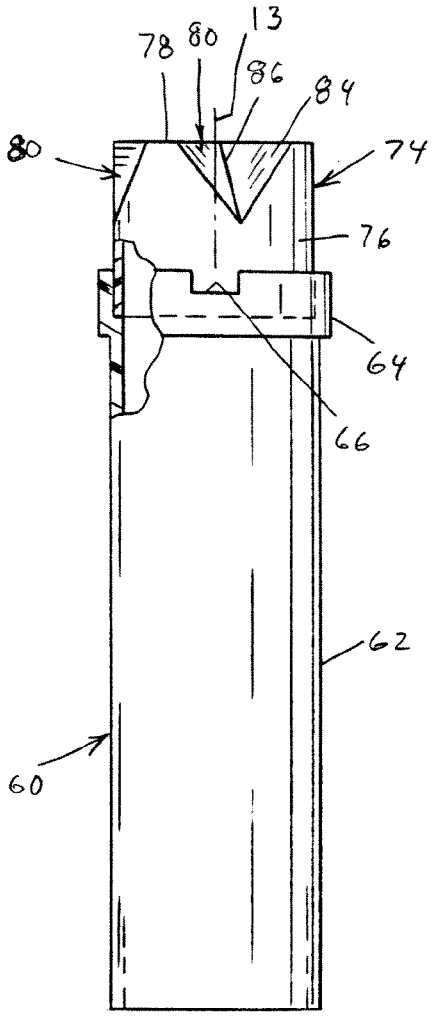
FIG. 19 is an isolated front view of the helix sleeve and seal.
Figure 20A:
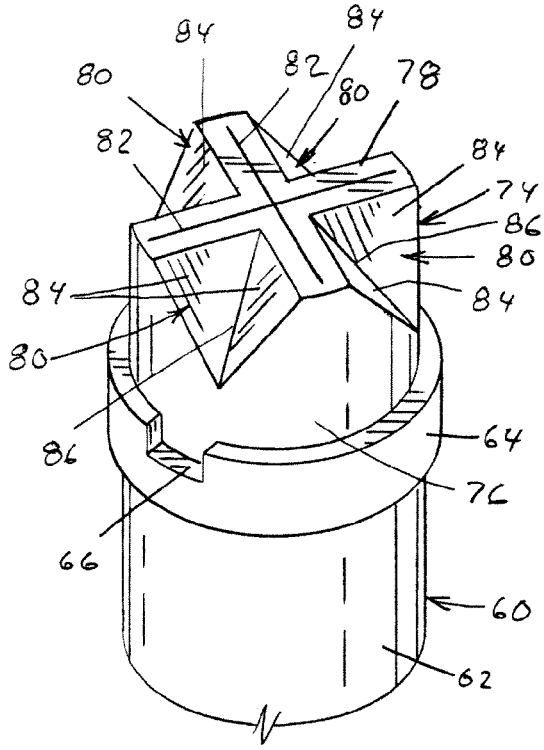
FIG. 20A is a top perspective view of the helix sleeve and seal in a close position.
Figure 20B:
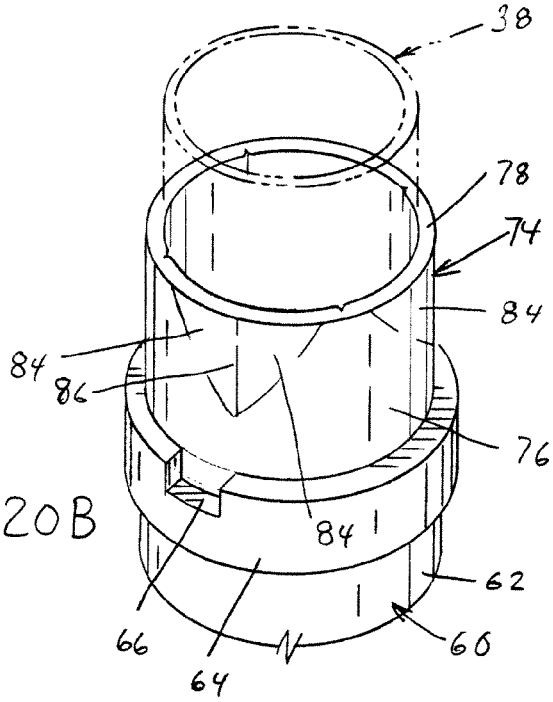
FIG. 20B is a top perspective view of the helix sleeve and seal in an open position.
Figure 21:
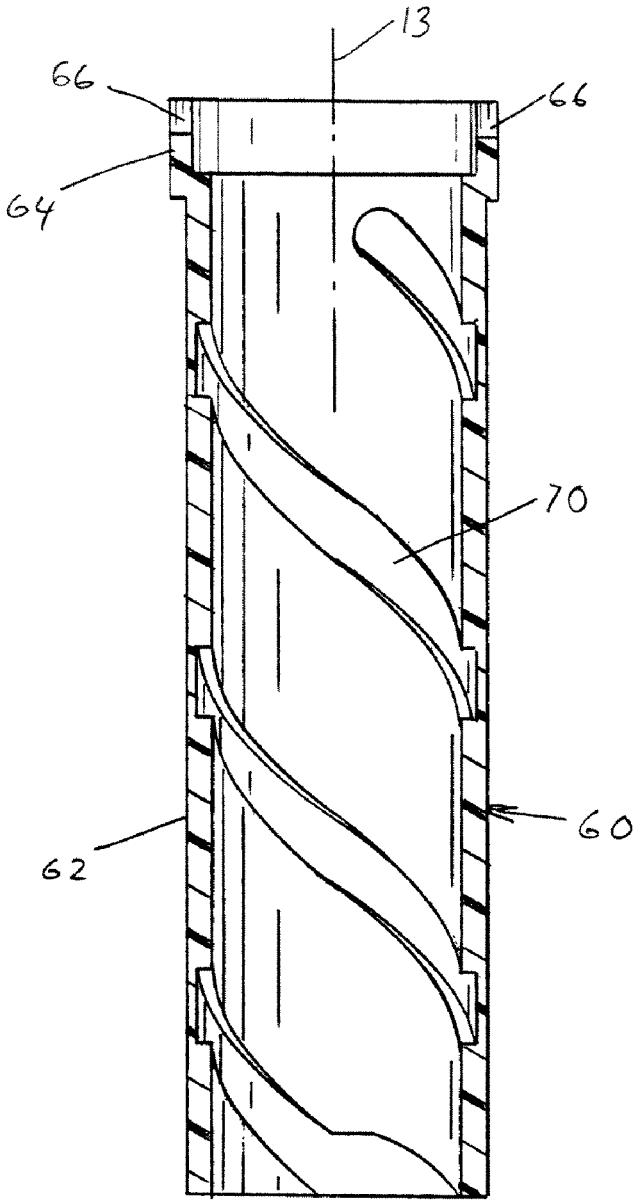
FIG. 21 is an isolated cross sectional view of the helix sleeve.
Figure 22:
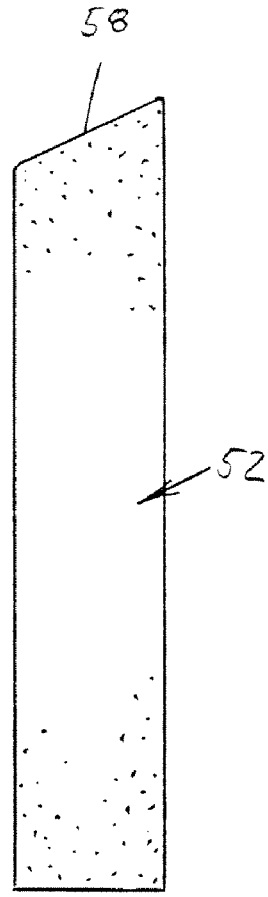
FIG. 22 is an isolated front view of the cosmetic product.

As can best be seen in FIGS. 19-20, the seal 74 has cylindrical side wall 76 and a top 78 cut into four identical sectors 80, two perpendicular slits 82 extending across two perpendicular diameters of the top 78. Each of the four sectors 80 are identical. Each of the four sectors comprise flat sheet-like segments 84 extending from a portion of the slits 82 downwardly at an angle of about 45°. Two adjacent sheets 84 intersect one another along a line 86 extending from the center of the top 78 to a point on the cylindrical side wall 76 below and half way between adjacent slits 82. This is the shape held by the seal 74 in its relaxed, closed position. In this configuration, the four sectors 80 of the seal 74 press against each other and the slits 82 are closed sealing the interior volume of the container body 12 and protecting the body of cosmetic 52 from contamination with dust or the like.

The above-described shape for the seal 74 is not required. Any shape allowing the seal to close and open as herein below described will work. Specifically, a simple sectored dome shape would work in the present disclosure. By a simple dome shape is meant a hemispherical elastomeric member cut by two perpendicular diametrical slits resulting in four sectors resembling the sectors one sees in the top of a quartered orange or grapefruit. Four planer triangular segments could also be used to form the seal 74. However, the embodiment described is believed to provide a superior sealing.

Figure 5:
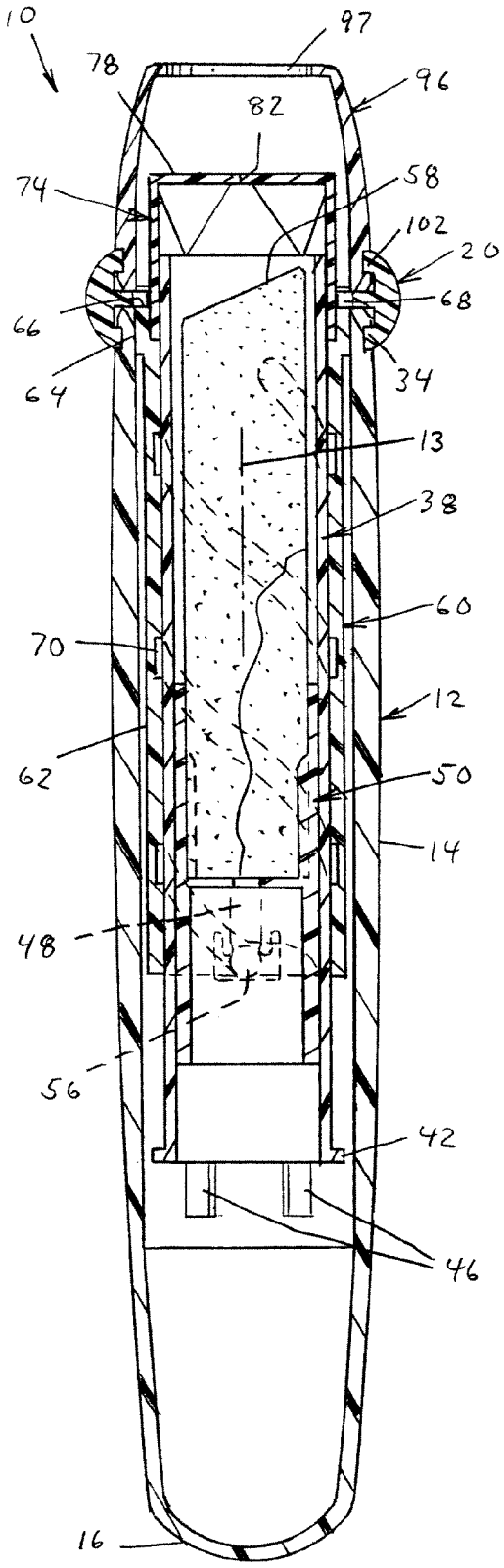
FIG. 5 is a cross sectional view of the applicator of FIG. 1 taken along line 5-5 of FIG. 1 showing the applicator in the close position.
Figure 6:
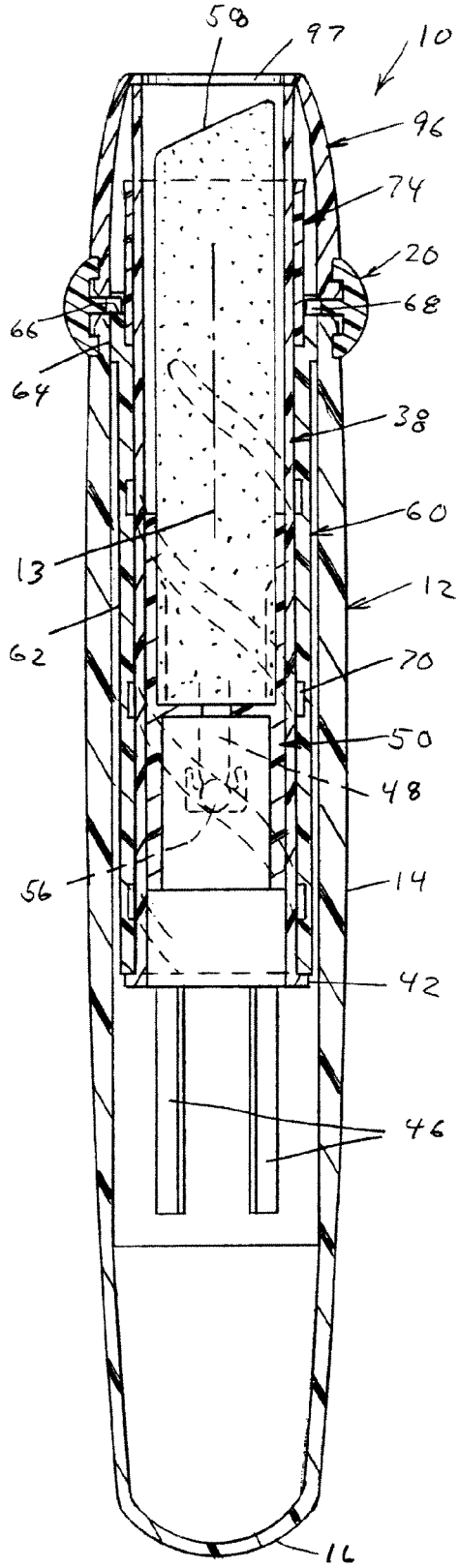
FIG. 6 is a cross sectional view showing the applicator as it moves from the close position to the open position.

The operation of the cosmetic applicator is best seen in FIGS. 5-8. In FIG. 5 the cosmetic applicator 10 is shown in cross section in the storage or closed state. In this state, the seal opening sleeve 38 is at the bottom of its range of axial travel as is the cosmetic containing cup 50. In this position, the bosses 56 are releasably retained at the bottom of the slots 48 and the seal opening sleeve 38. The bosses 56 are held in the bottom of the slots 48 by action of inwardly extending bumps or lips 90 adjacent the bottom of the slots 48. The lips 90 restrict the width of the slots 48 to slightly less than the diameter of the bosses 56. The bumps or lips 90 are supported on flexible arms 92 which allows the bosses 56 to disengage from the bumps or lips 90 if sufficient force is applied. However, in this closed position, the bosses 56 are held in the bottom of the slots 48 by the lips 90 and the cosmetic containing cup 50 will move axially in unison with the seal opening sleeve 38. In this configuration, the body of cosmetic 52, including its top 58, is surrounded by the seal opening sleeve 38 and protected by the sleeve 38. As the actuator ring 20 is rotated, the helix sleeve 60 rotates with it. The bosses 56, riding in the helixes 70, are urged axially upwardly which moves the cup 50 in the seal opening sleeve 38 upwardly toward the seal 74. When the seal opening sleeve 38 encounters the seal 74, the top edge of the seal opening sleeve 38 pushes the four sectors 80 of the seal 74 apart and outwardly. The seal opening sleeve 38 continues its upward movement in unison with the cup 50 until the seal opening sleeve encounters a stop. As seen in FIG. 6, in the embodiment illustrated, the stop is created by the impingement of the seal opening sleeve 38 outwardly extending flange 42 against the bottom of the helix sleeve 60. At the same time, the top edge of the seal opening sleeve 38 impinges against the inside top of the cap 96. Either of these stops can operate independently to provide the stop for the seal opening sleeve 38 or another stop mechanism may be employed.

Figure 7:
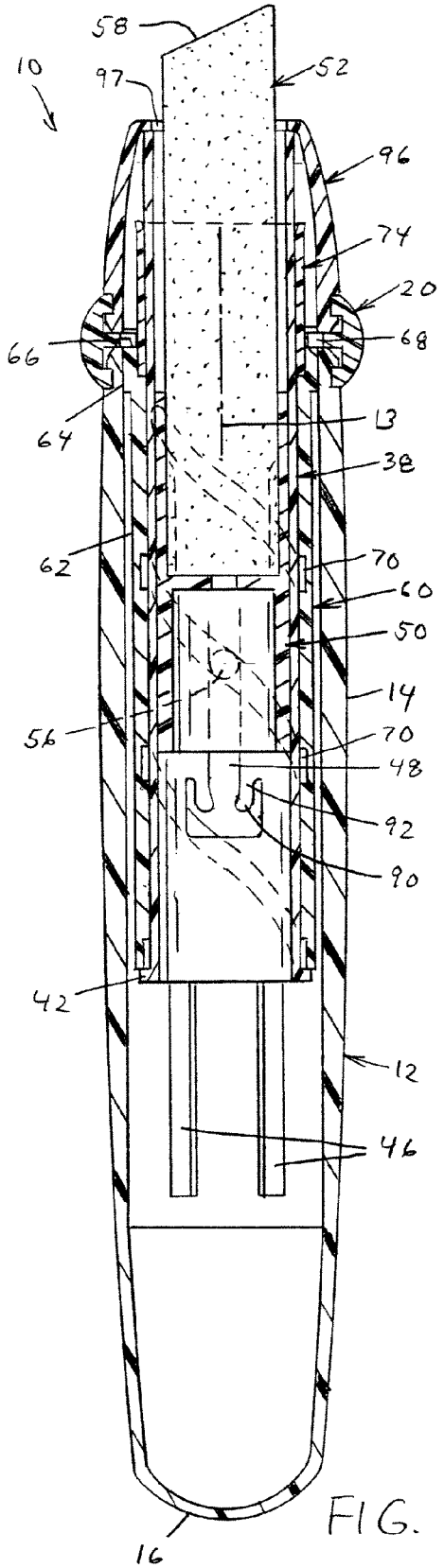
FIG. 7 is a cross sectional view showing the applicator in the open position in which a consumer may apply cosmetic.
Figure 8:
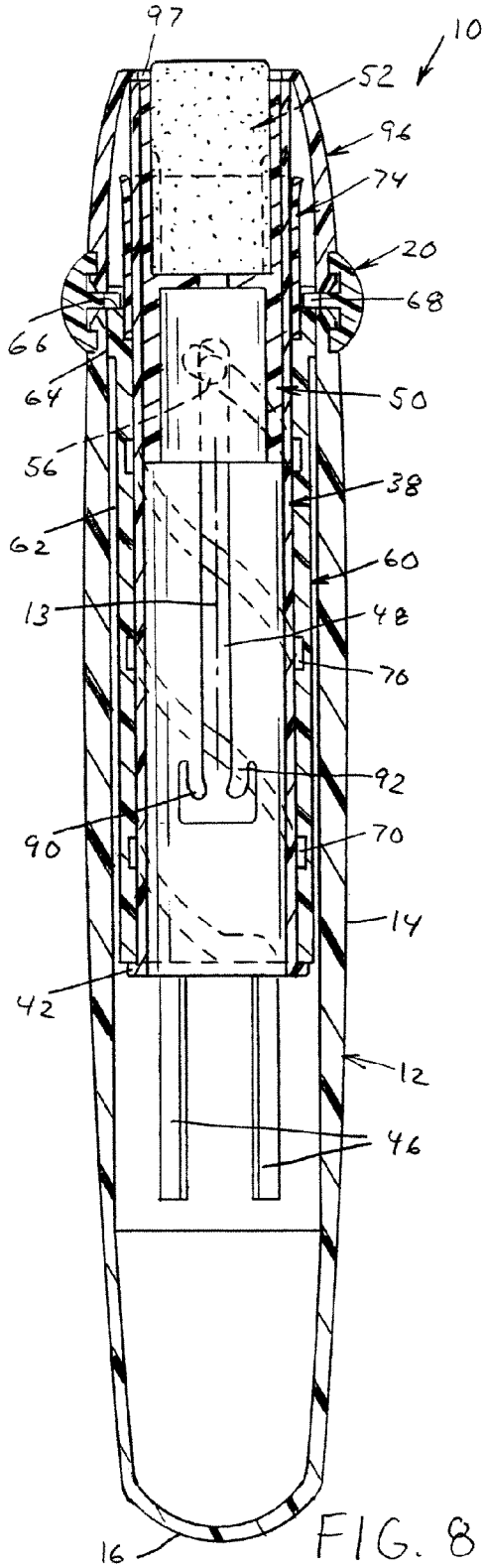
FIG. 8 is a cross sectional view showing the applicator in an open position after nearly all the cosmetic has been expended.

Cosmetic applicator 10 is shown in FIG. 6 with the seal opening sleeve 38 in its uppermost position. As can be seen in FIG. 6, the seal 74 has been forced into a generally cylindrical shape over its entire height with the top portions of the four sectors 80 resting against the outer surface of the seal opening sleeve 38. As rotation of the actuator ring 20 continues, the bosses 56 are forced upwardly past the bumps or lips 90 and the cup 50 moves upwardly with respect to the container body 12 and the seal opening sleeve 38. This allows the body of cosmetic 52 to project through the opening 97 in the top of the cap 96 where it is available for application by the consumer as seen in FIG. 7. When the consumer has completed use of the cosmetic applicator 10, and wishes to store the cosmetic applicator 10, the consumer rotates the actuator ring 20 in the opposite direction. This rotates the helix sleeve 60 in the opposite direction and urges the bosses 56 of cosmetic containing cup 50 downwardly. The cup 50 moves downwardly within the seal opening sleeve 38. During this motion, the seal opening sleeve 38 is restrained from moving downwardly because of the frictional engagement between the seal opening sleeve 38 and the four sectors 80 of the sleeve 74. The cup 50 proceeds to its lower most position with respect to the seal opening sleeve 38 wherein the bosses 56 slide by the bumps or lips 90 and engage the bottoms of the slots 48. In this position, (FIG. 6) the body of cosmetic 52, including its top 58, is surrounded by the seal opening sleeve 38. As the actuator ring 20 is rotated, the cup 50, the body of cosmetic 52, and the seal opening sleeve 38 move downwardly allowing the seal 74 to resume its at rest or closed position with the four sectors 80 engaging one another and sealing the cosmetic applicator. The cosmetic applicator 10 is now returned to the storage position seen in FIGS. 1 and 5.

The bumps or lips 90 positioned at the bottom of the slots 48 are not the only structure usable in the present disclosure for retaining the cup 50 releasably at the bottom of the seal opening sleeve 38. For instance, straight slots 48 could be used and a tight fit provided between the outer surface of the bottom of the cup 50 and the inner surface of the bottom of the seal opening sleeve 38. This tight fit would hold the two elements together axially until the seal opening sleeve 38 reached the top of its travel wherein the cup 50 would be forced away from this tight fit and travel on its own upwardly. Alternatively, a frictional surface could be applied to the bottom inner surface of the seal opening sleeve or outer surface of the cup 50. Alternatively, a barb and recess structure could be provided interengaging between the cup 50 and the seal opening sleeve 38 in a releasable manner. Alternatively, ribs extending from one or the other of the cup 50 of seal opening sleeve 38 could engage tight slots on the other of the cup 50 or seal opening sleeve 38. Any releasable interengagement mechanism can be used in this application without departing from the scope of this disclosure.

Figure 11:
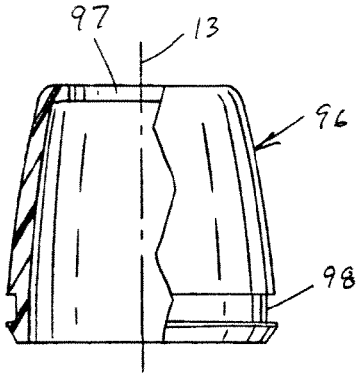
FIG. 11 is an isolated front view of the cap.
Figure 12:
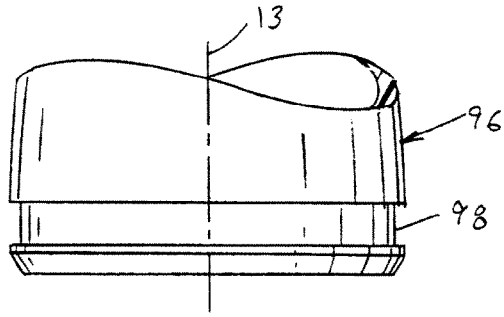
FIG. 12 is an enlarged view of the bottom end of the cap.
Figure 13:
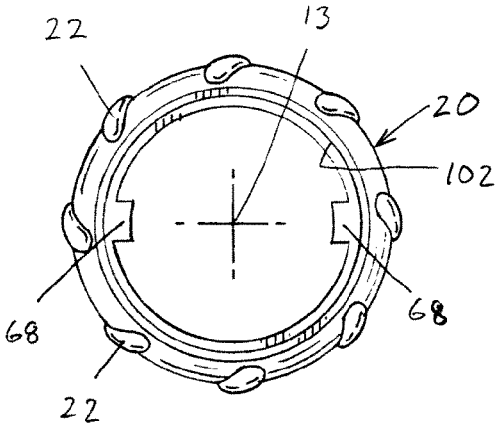
FIG. 13 is an isolated top view of the actuator ring.

With respect to retaining of the seal opening sleeve 38 in its upper position while the body of cosmetic 50 retracts from the application position, again, any releasable type restraint could be used. While use of the seal 74 against the outside surface of the seal opening sleeve 38 is efficient as it uses one element for two functions, this is not necessary. A frictional engagement between the top of the seal opening sleeve 38 and the inside surface of the cap 96 could reasonably provide the same function. A frictional engagement between a portion of the side wall of the seal opening sleeve 38 different from the top and a portion of the side wall of the container body 12 which only engage at the top of the range of motion of the seal opening sleeve 38 would also work. Friction between seal opening sleeve 38 and helix sleeve 60 or any combination of friction fits could also work The cap 96 (FIGS. 11 and 12) is generally cylindrical with a side wall tapering inwardly and upwardly to an open top 97. The bottom of the cap 96 is provided with a circumferential recess 98 which accepts a flange 102 on the actuator ring 20. Whether the cap 96 rotates with the actuator ring 20 or not is immaterial. The cap 96 could be fabricated as part of the actuator ring 20. Moreover, the cap 96 could be dispensed with altogether if the actuator ring 20 was made larger. The function of the cap 96 is to protect the seal 74 from contact with foreign objects which could possibly damage it or open it allowing the cosmetic contained within the container body 12 to be contaminated. The cap 96 is retained by the actuator ring 20 and remains secured thereto while the body of cosmetic 52 is moved back and forth from a storage or retracted position to an extended or dispensing position. It is to be appreciated that the cap 96 is not removed from the container body 12 during movement of the cosmetic 52 from the storage position to the extended position. The container body 12, actuator ring 20, seal opening sleeve 38, and cap 96 are symmetrically aligned about axis 13 and remain in axial alignment during movement of the cosmetic 52 from the storage position to the extended position.

As can be seen from the above description of the operation of cosmetic applicator 10, use of the cosmetic applicator 10 is most convenient and can be performed using one hand. The cosmetic applicator is placed in the hand with the bottom of the applicator near the palm of the hand. The thumb and forefinger can be used to operate the actuator ring 20 while the remaining fingers restrain the container body 12 from rotation. The cosmetic applicator 10 can be opened, the body of cosmetic 52 brought up to the desired level outside of the cosmetic applicator 10 (i.e. dispensing position), the cosmetic applied and the actuator ring 20 turned in the opposite direction to put the cosmetic applicator back in the storage or retracted position. This can be done entirely with one hand while maintaining a secure grip on the cosmetic applicator 10. Moreover, because the cosmetic applicator is a slim shape with a distinctive actuator ring near one end, it is easily located in a pocket or purse or glove compartment or central console compartment by tactile feel alone without the necessity for ambient/overhead lighting or other visual contact.

The above-described applicator can be used with many kinds of cosmetics. Any kind of stick cosmetic can be substituted for the body of cosmetic 52 described above. Moreover, a mascara brush can be mounted to the cup 50 with a cylindrical body of mascara adhered to the interior of the seal opening sleeve 38. In this application, the mascara brush is protected from the seal 74 by the seal opening sleeve 38. When the seal opening sleeve 38 reaches the top of its travel, the mascara brush continues upwardly the brush is presented in the ready to use configuration. The consumer can use the mascara brush, reverse rotation of the actuator ring 20 and return the mascara brush to the stored position without the mascara brush ever touching the seal 74. The action of the mascara brush bouncing around within the seal opening sleeve 38 while in the storage position will renew the mascara on the brush for the next use.

Figure 23A:
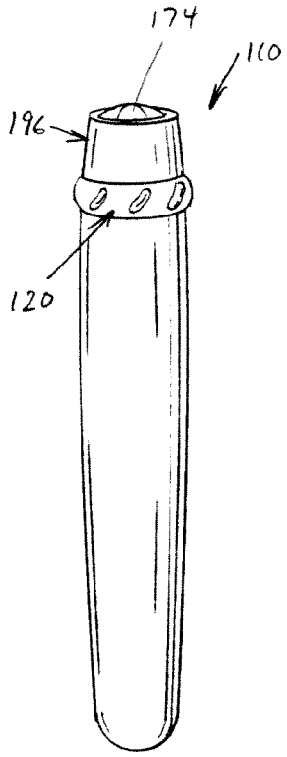
FIGS. 23A-23C are views of a second embodiment of the disclosure showing a single product in stages moving from the close position to the open position.
Figure 23B:
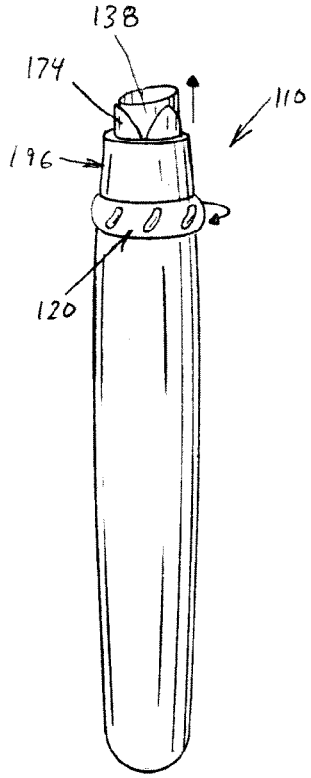
Figure 23C:
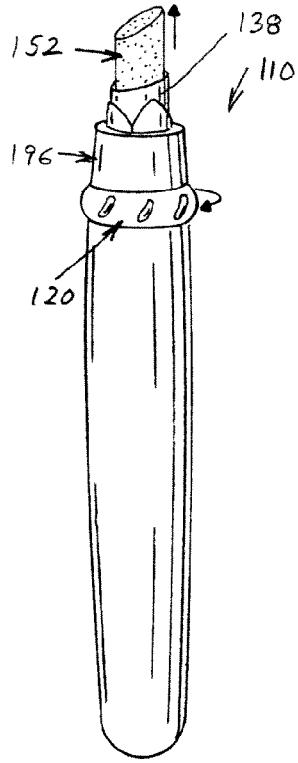

An alternative embodiment of a cosmetic applicator 110 is shown in FIG. 23A-23C. In this alternative embodiment, a seal 174 is positioned much more closely to the top of a cap 196 than in the first embodiment. The seal 174 is of the sectored round dome type consisting of four sectors of a hemisphere which will be closed into a hemispherical shape in the closed configuration seen in FIG. 23A. As an actuator ring 120 is rotated in FIG. 23B, a seal opening sleeve 138 moves upwardly, just as in the previous embodiment, impinges upon the four sectors of the seal 174 and opens the seal 174. However, in this embodiment, the four sectors of the seal are visible to the user as is the top of the seal opening sleeve 138. The seal opening sleeve 138 clears the top of the seal 174 and stops allowing the body of cosmetic 152 to continue its motion and be exposed above the seal opening sleeve 138 as seen in FIG. 23C. In this embodiment, the plastic seal opening sleeve 138 and the elastomeric seal 174 can both have metalized outer surfaces giving the cosmetic applicator a distinctive metal look.

In another modification of the exemplary embodiments, the helix sleeve and actuator ring can be deleted. In place of these elements, one or more of the bosses 56 extend through slots in the container body 12. The bosses are directly manipulated by the consumer. All other aspects of the internal workings remain the same, especially the operation of the seal opening sleeve 38 in protecting the body of cosmetic both in its extension movement and its retraction movement. The use of the extending bosses provides some of the advantages of the first described embodiment but not all of the advantages as the bosses are not closely adjacent the top of the applicator and one handed operation is somewhat more difficult and clumsy.

The disclosure has been described with reference to the illustrated embodiments. Obviously, modifications and alterations will occur to others upon the reading and understanding of the specification. Some of these modifications have been described, others will occur to the reader. It is intended to include such modifications and alterations and others insofar as they come within the scope of the appended claims and the equivalents thereof.

The invention claimed is:

1. A cosmetic applicator comprising:

a container body having at least one side wall, a closed bottom and a sealable open top;

an actuator ring engaging said container body wherein said actuator ring is proximal to said open top and being rotatable with respect to said container body;

a body of cosmetic having a top movably disposed within said container body;

a seal closing said container open top in a close state and opening said container open top in an open state, said seal changing between said close state and said open state in response to rotation of said actuator ring;

a cosmetic advance moving said body of cosmetic from a retracted position within said container body to an extended position in which a portion of said body of cosmetic extends through said container body open top in response to rotation of said actuator ring;

said actuator ring having a diameter and said container body having a diameter;

said actuator ring diameter is greater than said container body diameter;

said actuator ring position tactually orients said cosmetic applicator wherein said container body is adapted to be held in one hand and said actuator ring is moved by a thumb and forefinger of the same hand; and, wherein said cosmetic applicator has an axis and said cosmetic advance comprises a seal opening sleeve moving axially in response to rotation of said actuator ring, said seal opening sleeve adapted to surround said body of cosmetic top when said top moves past said seal.

2. The cosmetic applicator of claim 1, further including a cap retained by said actuator ring to said container body for protecting said seal from contact with foreign objects and contamination of said body of cosmetic; and, said cap, said actuator ring, and said container are symmetrically aligned about said axis.

3. The cosmetic applicator of claim 2, wherein said container body, said actuator ring, and said cap remain axially aligned while moving said body of cosmetic from said retracted position to said extended position, and back to said retracted position.

4. The cosmetic applicator of claim 1, wherein said container body, said actuator ring, and said seal are symmetrically aligned about said axis and remain axially aligned while moving said body of cosmetic from said retracted position to said extended position, and back to said retracted position.

5. A cosmetic applicator comprising:

a container body having an axis, at least one side wall, a closed bottom and an open top;

an actuator ring rotatable with respect to said container body adjacent said open top;

a helix sleeve at least partially within said container body and rotatable with said actuator ring, said helix sleeve having at least one helix;

an openable seal adjacent said container body open top having an open state and a close state, said seal closing said container body open top when in said close state;

a seal opening sleeve at least partially within said container body and non-rotatable with respect to said container body, said seal opening sleeve having at least one slot generally parallel to said container body axis, a retracted position and an extended position; said slot having a bottom;

a cup adapted to hold a body of cosmetic having an exterior surface and at least one boss extending outwardly from said exterior surface through said seal opening sleeve at least one slot into engagement with said at least one helix on said helix sleeve wherein said cup moves axially when said helix sleeve rotates;

a releasable engagement between said cup and said seal opening sleeve holding said seal opening sleeve to said cup when said seal opening sleeve is in said retracted position whereby said seal opening sleeve moves axially with said cup over a portion of its axial travel and said seal opening sleeve opens said seal allowing said body of cosmetic to project through said seal and said container body open top for use;

said actuator ring having a diameter and said container body having a diameter;

said actuator ring diameter is greater than said container body diameter; and, said actuator ring position tactually orients said cosmetic applicator wherein said container body is adapted to be held in one hand and said actuator ring is moved by a thumb and forefinger of the same hand.

6. The cosmetic applicator of claim 5, wherein:

said seal opening sleeve is releasably held in position with respect to said seal when said seal opening sleeve is in said extended position whereby said body of cosmetic in said cup retracts to within said container body upon rotation of said actuator ring before said openable seal returns to said close state.

7. The cosmetic applicator of claim 6, wherein said releasable engagement between said cup and said seal opening sleeve is a restriction near the bottom of said sealing opening sleeve slot.

8. The cosmetic applicator of claim 7, wherein said slot restriction is at least one inwardly extending projection restricting the width of said slot.

9. The cosmetic applicator of claim 8, wherein said seal opening sleeve is releasably held in said extended position by frictional engagement with said openable seal.

10. The cosmetic applicator of claim 5, further including a cap retained by said actuator ring to said container body for protecting said seal from contact with foreign objects and contamination of said body of cosmetic; and, said cap, said actuator ring, and said container are symmetrically aligned about said axis.

11. The cosmetic applicator of claim 10, wherein said container body, said actuator ring, and said cap remain axially aligned while moving said body of cosmetic from said retracted position to said extended position, and back to said retracted position.

12. The cosmetic applicator of claim 5, wherein said container body, said actuator ring, and said seal are symmetrically aligned about said axis and remain axially aligned while moving said body of cosmetic from said retracted position to said extended position, and back to said retracted position.

* * * * *